United States Patent [19]

Maschewski

[11] Patent Number: 4,721,341

[45] Date of Patent: Jan. 26, 1988

[54] CUTTING HEAD FOR A SELECTIVE CUTTING MACHINE

[75] Inventor: Gerhard Maschewski, Dortmund, Fed. Rep. of Germany

[73] Assignee: Gewerkschaft Eisenhutte Westfalia GmbH, Postfach, Fed. Rep. of Germany

[21] Appl. No.: 917,014

[22] Filed: Oct. 9, 1986

[30] Foreign Application Priority Data

Oct. 25, 1985 [DE] Fed. Rep. of Germany ..... 3537981

[51] Int. Cl.[4] ..... E21C 7/08

[52] U.S. Cl. ..... 299/81

[58] Field of Search ..... 299/81, 12, 17

[56] References Cited

U.S. PATENT DOCUMENTS 3,290,097 12/1966 Hlinsky et al. ..... 299/81
3,374,033 3/1968 Arentzen ..... 299/81
4,049,318 9/1977 Fruin ..... 299/81

FOREIGN PATENT DOCUMENTS 3222580 2/1984 Fed. Rep. of Germany ..... 299/17
1207817 10/1970 United Kingdom ..... 299/81

*Primary Examiner*—George A. Suchfield
*Attorney, Agent, or Firm*—Samuels, Gauthier, Stevens & Kehoe

[57] ABSTRACT

A cutting head for a selective cutting machine includes internally-fed spraying means including a high pressure water control means which is designed in such a way that only spray nozzles adjacent to cutting tools that are actually cutting are supplied with water under pressure. The water under pressure is supplied from a boom to the rotating cutting head via a piston whose free end surface is pressed, by the pressurized water, against a control surface provided on the cutting head. Said free end surface is formed with a control opening which overlaps control ducts provided in the control surface during rotation of the cutting head, thereby controlling the flow of pressurized water to the various groups of spray nozzles. Non-return valves, which keep the control ducts closed, when they are not aligned with the control opening of the piston, are located in the control ducts.

26 Claims, 10 Drawing Figures

FIG.7
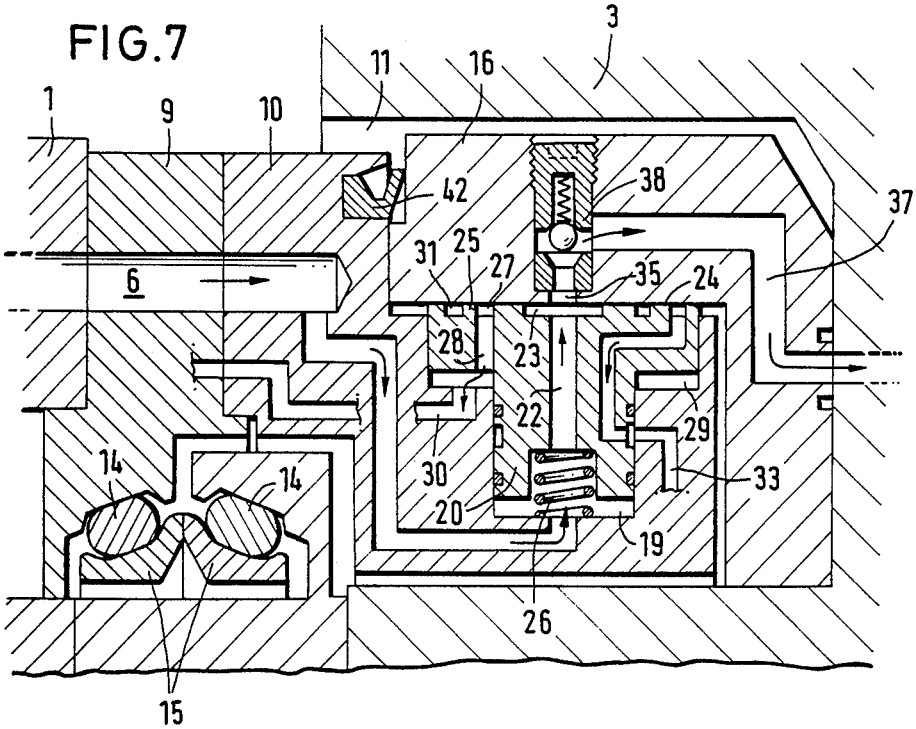
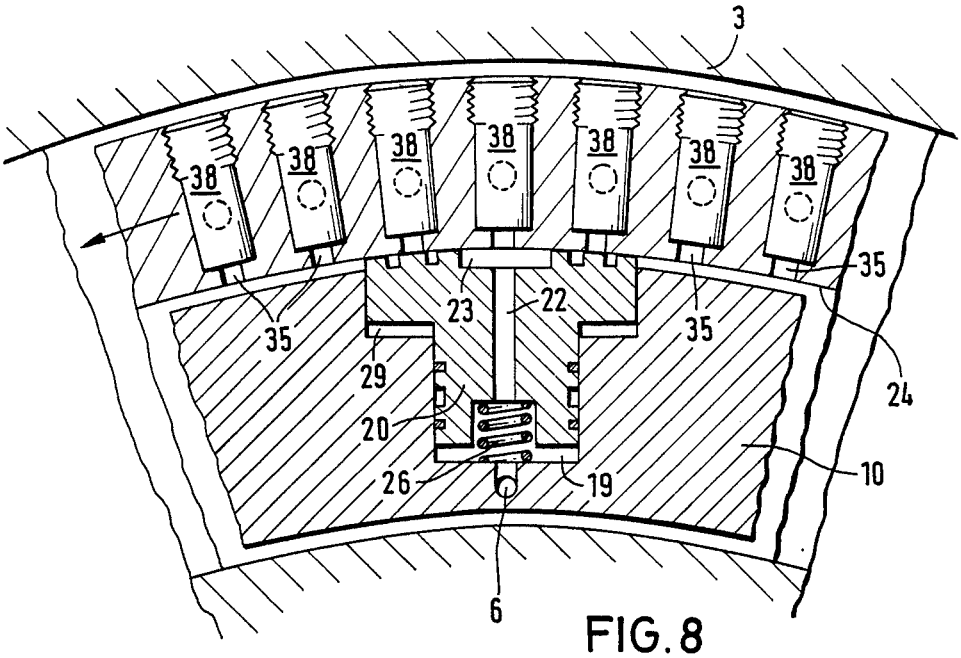
FIG.8

CUTTING HEAD FOR A SELECTIVE CUTTING MACHINE

BACKGROUND OF THE INVENTION

This invention relates to a cutting head for a selective cutting machine.

Typically, such a cutting head is mounted on a boom, and is provided with a high pressure water supply line arranged on the boom. The supply line is connected, by means of a high pressure water duct, to a sliding member which is loaded by the pressurised water and is adjustable against a control surface of the rotating cutting head. The sliding member is formed with a duct which connects the high pressure water duct to the control surface; and control ducts, which open onto the control surface, are provided. The control ducts are arranged on a common graduated circle, and lead to the spray nozzles of the cutting head.

Selective cutting machines are used to advance tunnels, galleries or the like, through faces and seams in underground mines and for the winning of mineral deposits. Such a machine is equipped with a cross-axis cutting assembly having two cutting heads mounted on a pivotal boom, the two cutting being driven by a shaft orientated transversely to the boom (Journal "Glückauf", 1985, page 1206). To abate the dust formed during cutting operations, to assist the cutting work by cooling the cutting tools, and to avoid methane flame scarfing in fire-damp mines, it is necessary to spary the working region with water under pressure. Generally, internal spraying is adopted, that is to say water under pressure is supplied from the exterior, and is introduced into the cutting heads via rotary arrangements. The pressurized water is then conveyed, via high pressure water ducts in the cutting heads, to spray nozzles arranged on the periphery of the cutting heads. A cutting head having such internally-fed spray nozzles is usually equipped with means for controlling the supply of pressurized water which ensures that water is fed only to the spray nozzles located in the region of the cutting head whose cutting tools are actually cutting (see DE-OS No. 28 10 982 and EP-PS No. 10 534).

In many applications, it is necessary to spray water intentionally into the working region of the individual cutters, that is to say into the cutting tracks thereof, in such a way that effective cooling of the cutting zones is achieved, whilst ignition of issuing methane gases by spark formation in the cutting zone is prevented. Operating pressures of the order of at least 100 to 200 bar, and often even of 300 bar and higher. are required for the spray water. Considerable sealing problems arise at such high working pressures if the rotary arrangement is arranged on the drive shaft or hub of the cutting head. The sealing problems are greater, the greater the diameter of the shaft or hub of the cutting head provided with the rotary arrangement. When using a planetary gear positioned within a cutting head, the shaft diameter to be sealed by the rotary arrangement is not excessively large, so that the sealing problems can generally be solved, at least if the working pressures of the spray water are not too high. The conditions may be different if a mitre gear is provided instead of the planetary gear. The use of a mitre gear has the significant advantage over a planetary gear that a cutting head can have a reduced diameter. On the other hand, considerable problems arise in providing the resultant large diameter drive shaft with a rotary arrangement for the supply of pressurized water which acts as a reliable seal over a prolonged operating period at the high pressures required.

A further known cutting head has an internally-fed spraying arrangement in which a piston-like pressure ring surrounding the shaft acts as the sliding member for conveying pressurised water into the rotating cutting head and for controlling the supply of pressurized water in such a way that only those spray nozzles in the cutting region are supplied with pressurised water. The pressure ring carries a control ring, and is charged with pressurised water in such a way that the control ring is pressed axially against a control surface which rotates with the cutting head, and in which there are located control ducts through which the individual spray nozzles are supplied with the pressurised water (see DE-OS No. 31 22 955). This spraying arrangement necessitates relatively high production costs, and can give rise to sealing problems, in particular at the above-mentioned high pressures of the water used.

The object of the invention is to provide a cutting head having internally-fed spray means which permits internal spraying to be achieved, even at very high water pressures of up to 300 bar or higher, without particular problems of sealing and wear arising in use.

SUMMARY OF THE INVENTION

The present invention provides a cutting head for a selective cutting machine, the cutting head being rotatably mounted on a boom, the cutting head including a plurality of control ducts for feeding pressurised water to spray nozzles, the control ducts leading from a control surface formed on the cutting head and being arranged around the periphery of a circle which is concentric with the axis of rotation of the cutting head, the control ducts being connected to a high pressure water supply line via a piston having a free end surface which is slidable over the control surface, the piston being provided with a passage passing therethrough, one end of the piston passage being connected to the high pressure water supply line, and the other end of the piston passage terminating in a control opening formed in said free end surface of the piston.

The cutting head may further comprise valve means for preventing the return of pressurised water to control ducts not aligned with the piston.

Therefore, instead of the known annular sliding member, a small piston is used for conveying pressurised water into the rotating cutting head. This piston is forced, by the pressure of the water supplied, against the control surface, and its control opening is overlapped, during rotation of the cutting head, by the control ducts thereof. The respective control ducts which are not aligned with the control opening are sealed by the valve means against return of the water under pressure. As the piston has a relatively small pressure-loaded piston area, and as release of pressure can take place from the control opening, correspondingly small area pressures occur on the control surface, so that the frictional wear is kept within limits with sufficient sealing action. Slight leakages of water through the gap between the free end surface of the piston and the control surface are insignificant. If desired, the leaked water can be recirculated using conventional means. It is particularly advantageous if the free end surface of the piston can adapt itself to the control surface, and any irregularities thereof, so that no particular requirements have to be imposed on the precise machinery and regularity of the control surface. As the free end surface of the piston wears on the rotating control surface to a certain extent, the sealing action is further improved by the surface wear. The travelling piston is thus automatically adjusted, so that it always maintains a sealing contact on the control surface. A rough sliding surface does not represent a disadvantage in itself. It can form lubricating bore reliefs and labyrinth surface seals. It is advisable to provide the piston with protection against twisting about its longitudinal axis, so that the adaptation of its free end surface to the control surface due to wear is assisted. Furthermore, the piston seals arranged on the piston are saved from wear. In addition, with the piston seal according to the invention, a fine water film which lubricates and cools the sliding surfaces can build up on the control surface.

The piston is preferably of stepped construction, which leads to a correspondinly stepped passage. Its control opening preferably has a greater cross-sectional area than its piston passage. Advantageously, the piston passage is a passage axially penetrating the piston over its entire length. The device is preferably arranged in such a way that the piston passage opens into a control opening of such a size that at least one control duct is intersected by the control opening of the piston at any moment. Undesirable surges of pressure are thus avoided when conveying the high pressure spraying water into the rotating cutting head.

It is advisable to arrange, on the free end surface of the piston, an annular groove which surrounds the control opening, and is connected to a leakage duct. In this way, a stream of leaking water is produced during the cutting operation, and effects lubrication and cooling of the surfaces. The piston can also be provided with at least one duct for the continuous supply of lubrication grease, said duct terminating at the free end surface of the piston, preferably in an annular groove which surrounds the annular groove connected to the leakage duct. Grease lubrication improves the lubricating and sealing action at the sliding faces.

In a preferred embodiment of the invention, the stepped piston is movably mounted in a stepped passage whose passage portion of smaller diameter is connected to the high pressure water supply line, and whose passage portion of larger diameter is connected to the leakage duct, the piston passage opening into the passage portion of smaller diameter, and the leakage cut opening into the passage portion of larger diameter.

The stepped piston is advantageously formed in an annular ancillary plate which is detachably fixed to the side of the boom. Similarly, it is advisable to arrange the control ducts in an annular ancillary plate arranged detachably on the side of the cutting head. Assembly and disassembly of the components involved in the supply of pressurised water, and the control of the supply of pressurised water is simplified by these structurally simple design measures. The gap between the ancillary plates can be reliably sealed by a sealing ring.

The spraying arrangement according to the invention allows spraying of the cutting track, without excessive production costs, in such a way that only the spray nozzles in the cutting region are loaded with water under pressure. This can be achieved, in an advantageous manner, in that several adjacent control ducts are joined together to form a group, by means of connecting ducts, each group being connected to the spray nozzles arranged over a predetermined cutting head sector.

In the spraying arrangement according to the invention, it is also possible to use several pistons, each of which makes sliding contact with a common control surface, or with a respective individual control surface. The control ducts can also be arranged in concentric circles instead of over a single graduated circle for distribution of pressurised water to the individual spray nozzles or spray nozzle groups. If only a single sliding piston is used here, the control opening thereof is designed in such a way that it intersects the control ducts of the concentric circles.

In a preferred embodiment of the invention, the piston is arranged in such a way that its longitudinal axis runs parallel to the axis of rotation of the cutting head. However, it is also possible to arrange the piston (or pistons) with its longitudinal axis transverse to the axis of rotation of the cutting head. In this case, the sliding piston is adjustable by pressurised water radially against an annular cylindrical control surface provided on the cutting head.

BRIEF DESCRIPTION OF THE DRAWINGS

Embodiments of the invention will now be described in detail, by way of example, with reference to the accompanying drawings, in which:

FIG. 7 shows a third embodiment in a sectional view corresponding to FIG. 3;

FIG. 8 shows the embodiment of FIG. 6 in a partial section perpendicular to the axis of the rotation of the cutting head;

DESCRIPTION OF PREFERRED EMBODIMENTS

Figure 1:
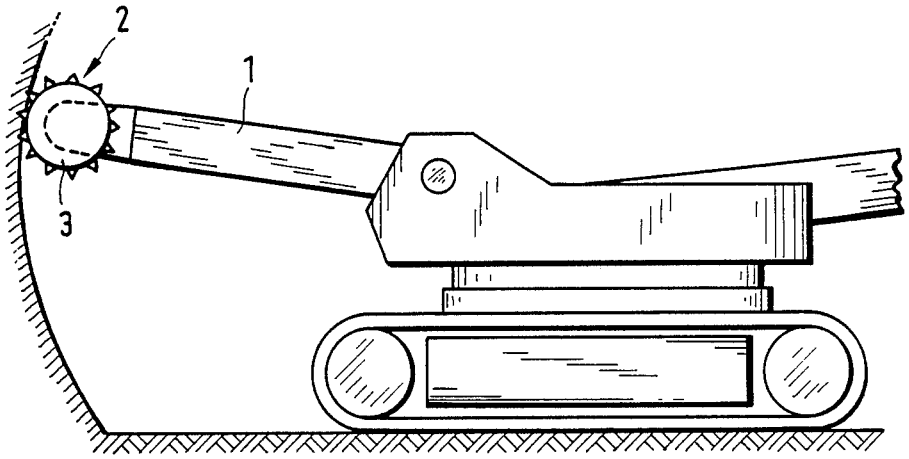
FIG. 1 is a schematic side view of a selective cutting machine incorporating a cross-axis cutting assembly provided with internally-fed spray means.

Referring to the drawings, FIG. 1 shows a known type of roadheader (selective cutting machine) which is used as an advance or winning machine. The machine frame is supported by caterpillar tracks, and is provided with a laterally and vertically pivotal boom 1 bearing on its free end a cross-axis cutting assembly which has two cutting heads 3 which are rotatable about a common axis of rotation running transversely to the boom axis. Each of the cutting heads 3 is equipped with cutting tools 4, which are indicated schematically in FIG. 2. The common drive of the two cutting heads 3 is not shown, being located together with gearing in the interior of the boom 1 which is of box girder construction. The two cutting heads 3 are arranged in rotationally engaged manner on a drive shaft 5 running transversely to the boom 1.

Each of the cutting heads 3 is provided with a spraying arrangement in the form of a so-called internally-fed spray means. The spray means direct pressurized water to spray nozzles (not shown) arranged on the peripheries of the cutting heads 3. A respective high pressure water supply line 6 (shown in broken lines in FIG. 2) is provided for each cutting head 3, these lines being housed inside the boom 1. High pressure water is conveyed into the right-hand side rotating cutting head 3 in the region II indicated by dot-dash lines in FIG. 2, this region being shown on a larger scale in FIGS. 3 to 5. The left-hand side cutting head 3 is provided with pressurised water in a similar manner.

Figure 2:
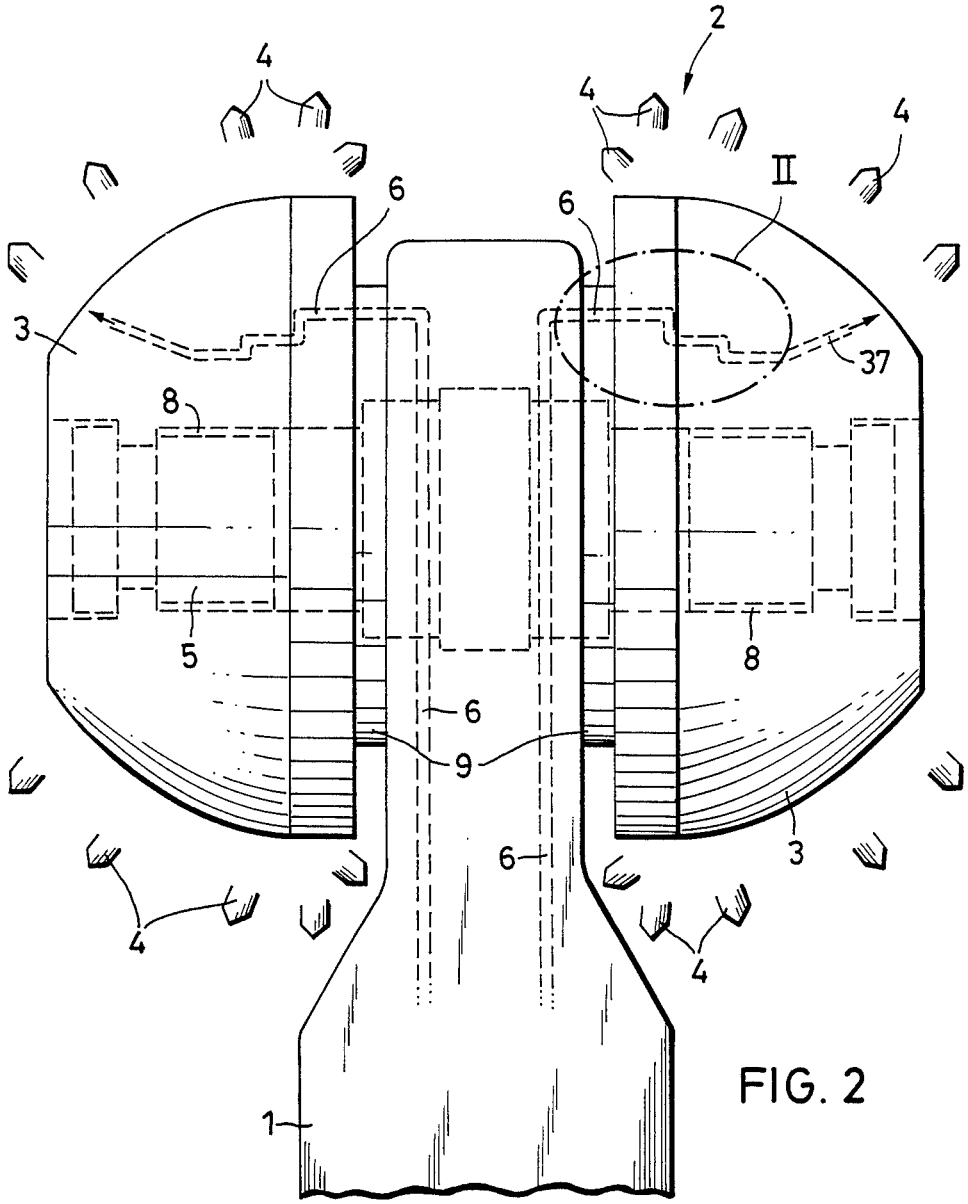
FIG. 2 is a schematic plan view of the cross-axis cutting assembly of FIG. 1.
Figure 3:
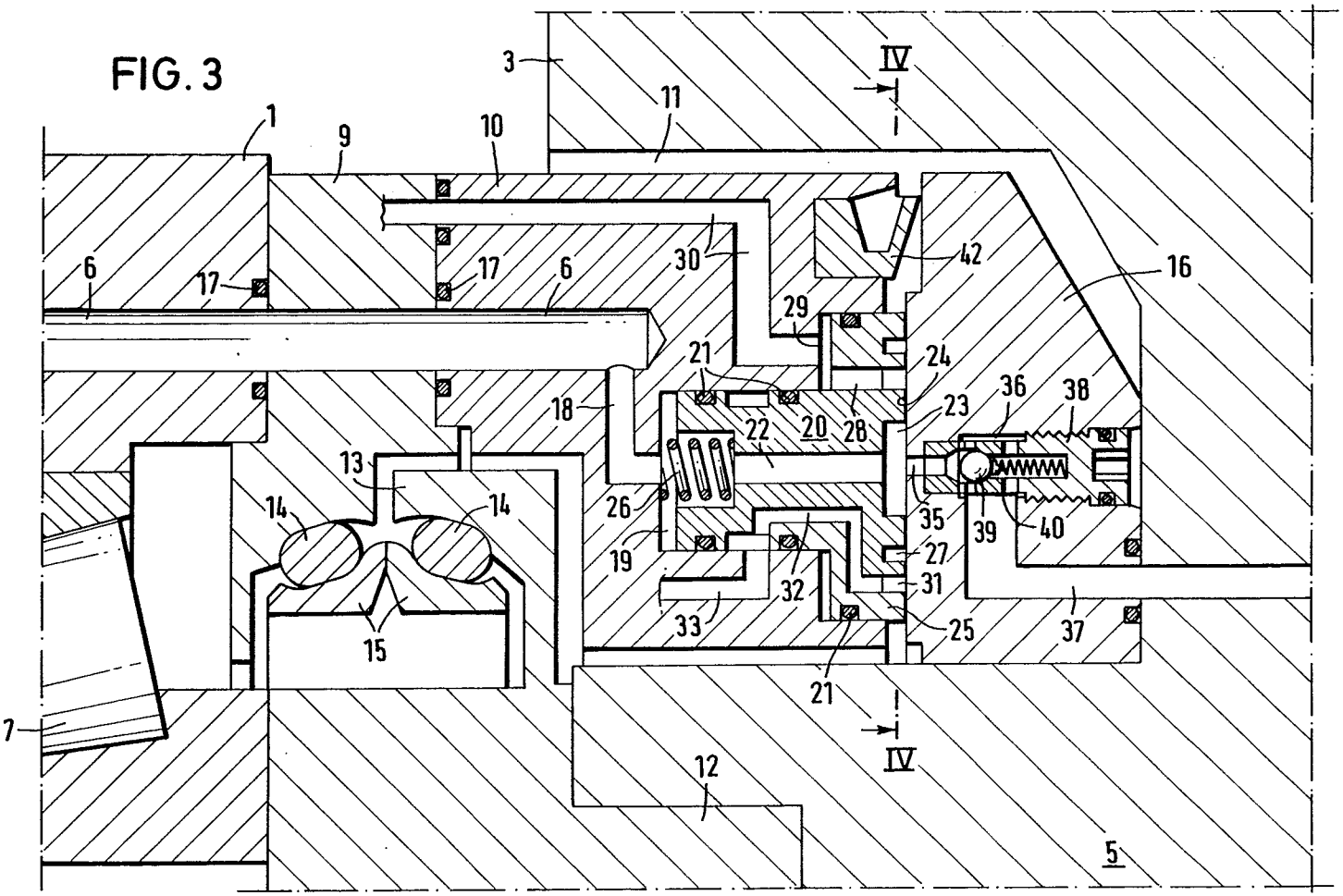
FIG. 3 shows the region of one cutting head and the boom indicated in FIG. 1 by the dot-dash border II, on an enlarged scale and in a partial section perpendicular to the axis of rotation of the cutting head.

The right-hand side of that portion of the boom 1 lying between the two cutting heads 3, together with a rolling bearing 7 for the drive shaft 5, is shown on the left of FIG. 3, and the associated cutting head 3 (which is connected in rotationally engaged manner to the shaft 5 by means of splines 8—see FIG. 2) is shown in partial section on the right of FIG. 3. An annular ancillary plate 10, which surrounds the shaft 5 and engages within an annular tapered portion 11 of the cutting head 3, is fixed laterally onto the cutting boom 1 by means of an annular intermediate plate 9. An annular member 12, having a radial projection 13 which fits into an annular tapered portion defined by the two plates 9 and 10, is connected to the cutting head 3. A known seal, consisting of two metal rings 15 held in sealing contact by elastic pressure rings 14, is arranged between the projection 13 of the annular member 12 and the intermediate plate 9. An annular ancillary plate 16, which is detachably connected to the cutting head 3, for example by screwing, is located in the tapered end portion 11 of the cutting head. The plate 16 is concentric with the axis of rotation of the cutting head 3.

The supply line 6 extends through the plates 9 and 10, and is sealed with respect to the adjacent plate surfaces by means of O-rings 17. A high pressure water duct 18 leads from the end of the line 6 to the base of a stepped cylindrical passage 19 in which a stepped piston 20 is slidingly housed. The piston 20 is sealed with respect to the passage 19 by piston seals 21. The piston 20 is provided with an axial piston passage 22 which connects the high pressure water duct 18 and the duct system of the cutting head via the ancillary plate 16. The piston passage 22 ends in a control opening 23 which has a greater cross-sectional area than the passage 22. The ancillary plate 16 forms a smooth annular control surface 24 against which the larger area free end face 25 of the piston 20 rests. A spring 26, which abuts the base of the stepped passage 19, holds the piston 20 in face-to-face contact with the control surface 24. The smaller area free end of the piston 20 is loaded by high pressure water supplied via the ducts 6 and 18, whereby its end face 25 is pressed hydraulically against the control surface 24.

The end face 25 of the piston 20 is formed with an annular groove 27 which concentrically surrounds the control opening 23. The annular groove 27 is connected, via a short axial passage 28, to an annular chamber 29 formed behind the shoulder of the stepped piston 20. A leakage duct 30, through which water leaking through the gap between the control surface 24 and the piston end face 25, is connected to the annular chamber 29. The leakage duct 30 discharges leaked water away from the cutting head 3, or recirculates it.

The end face 25 of the piston 20 also has a larger diameter annular groove 31, which is concentric with the piston axis. The groove 31 is connected, via a duct 32 formed in the piston 20 and a connecting duct 33 formed in the ancillary plate 10, to a lubricating grease supply (not shown). Lubricating grease is continuously fed to the annular groove 31, where it effects sealing and lubrication of the control surface 24.

Figure 5:
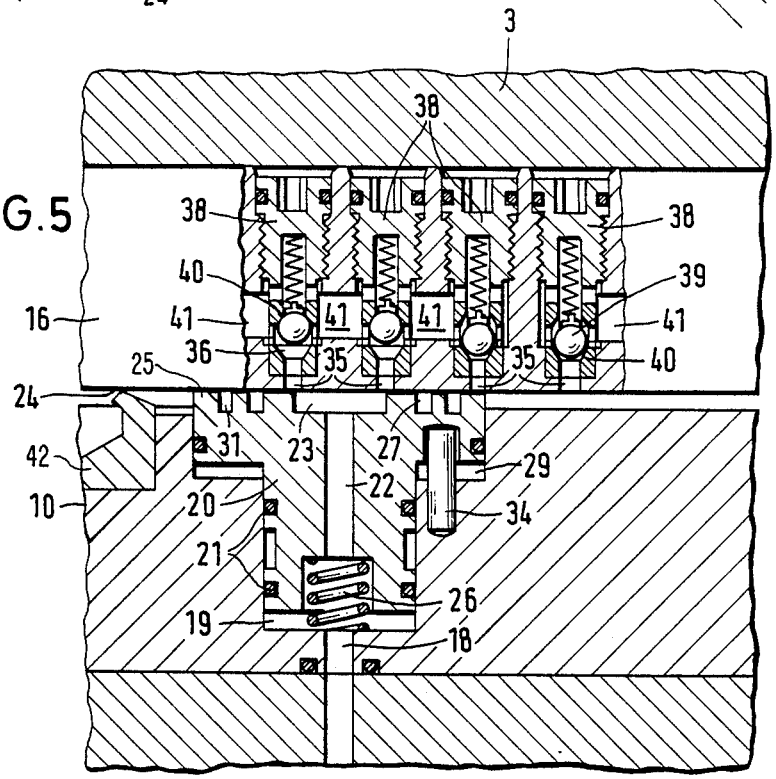
FIG. 5 is a cross-section taken on the line V—V of FIG. 4.

As shown in FIG. 5, the piston 20 is secured against rotation relative to its piston axis by means of a rotation prevention means 34 constituted by a pin which fits into passages in the piston and ancillary plate 10. The annular gap on the outer periphery between the two ancillary plates 10 and 16 is sealed by a flexible sealing ring 42.

Figure 4:
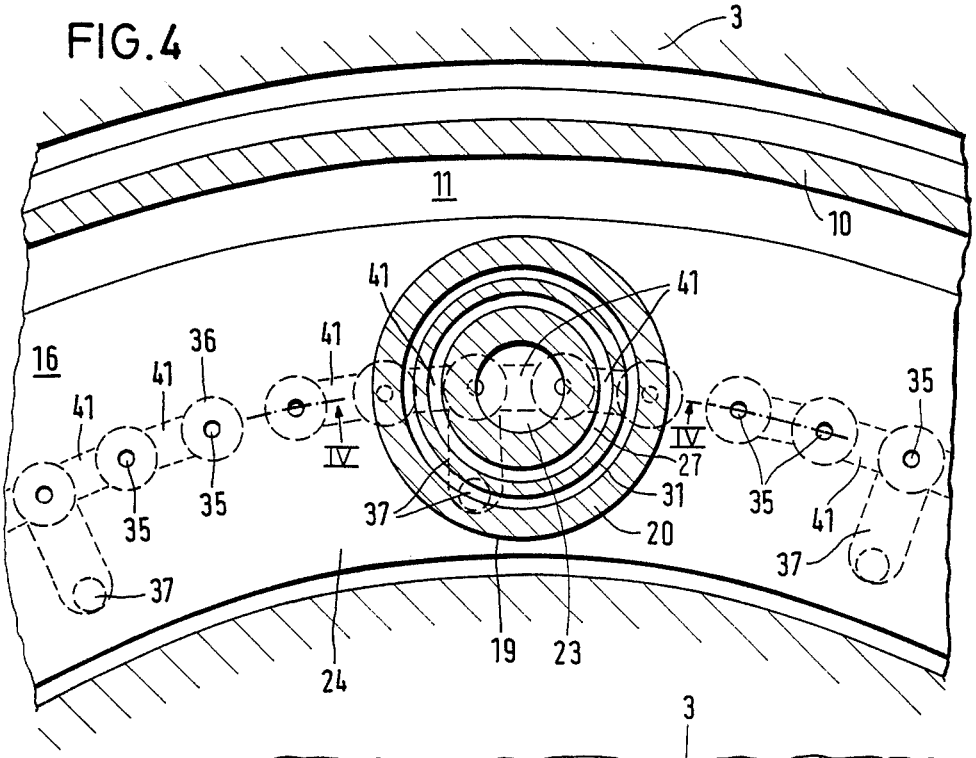
FIG. 4 is a cross-section taken on the line IV—IV of FIG. 3.

The ancillary plate 16 is detachably fixed to the cutting head 3, for example by screw fittings, and is formed with a plurality of control ducts 35 which are equispaced over its periphery. The control ducts 35 open into the control surface 24, and each is connected by a respective stepped passage 36 formed in the ancillary plate 16 to a connecting duct 37 which extends through the cutting head 3 and provides a connection to a group of spray nozzles arranged on the periphery of the cutting head. As shown in FIGS. 4 and 5, the control ducts 35 of each group of five adjacent control ducts are connected by transverse ducts 41 located between the passages 36. Consequently, the five ducts 35 of each group are attached, via a common duct 37 to a respective group of spray nozzles. The cutting head 3 thus includes an internally-fed spray means which is such that pressurised water is supplied only to spray nozzles which are adjacent to cutting tools 4 that are actually cutting. A respective non-return valve 38 is arranged in each of the stepped passages 36. These valves 38 are spring-loaded ball check valves, and are screwed into the passages 36, from the plate side opposite to the control surface 24 as valve cartridges. The non-return valves 38 each have a lateral conical support surface 40 which receives the associated valve ball 39 when the associated valve is completely open.

During cutting, the ancillary plate 16 rotates together with the cutting head 3 relative to the ancillary plate 10 and the piston 20 whose piston end face 25 rests tightly on the control surface 24. The individual control ducts 35 are passed over in succession by the control opening 23, so that the high pressure water connection from the control opening to successive control ducts is produced. As high pressure water is supplied to a given control duct 35, this is effective to open the associated non-return valve 38, thereby supplying pressurised water to the respective duct 37 and to the group of spray nozzles connected thereto. In the open position, the valve ball 39 of each valve 38 rests on its conical support surface 40, so that its position is not influenced by the rotation of the cutting head 3. As the piston 20 only covers the annular control surface 24 over a small proportion of its circumference the pressure exerted on the piston by the pressurised water entering the passage 19 is not excessively high. A small quantity of water will flow, during operation, radially outwards from the control opening 23, via the annular groove 27, to the leakage duct 30. A fine film of water is, therefore, formed on the control surface 24, and this effects lubrication and cooling of the faces sliding on one another. Further lubrication and sealing in the peripheral region of the piston end face 25 is achieved by the lubricating grease continuously supplied to the annular groove 31.

Wear occurring on the faces 24 and 25 causes these faces to adapt to one another, thereby improving the sealing action. As the piston 20 is continuously loaded towards the control surface 24 by the high pressure water, the surface contact on the control surface is also maintained after wear of its end face 25.

As shown in FIGS. 4 and 5, the control opening 23 is dimensioned such that, at any given time, a control duct 35 is approached by the control opening. Consequently, independently of the respective rotational position of the ancillary plate 16 relative to the stationary piston 20, a control duct 35 is always covered by the control opening 23, whereby undesirable pressure surges are avoided during rotation of the cutting head 3.

Figure 6:
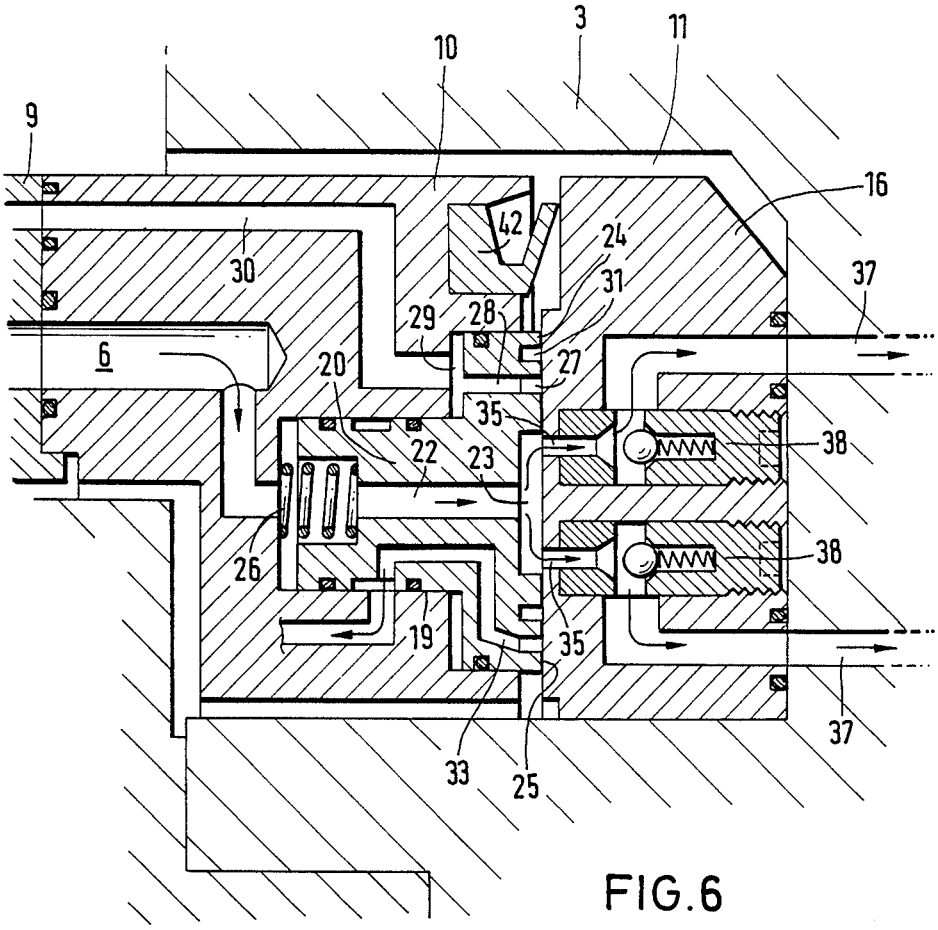
FIG. 6 shows an alternative embodiment in a sectional view corresponding to FIG. 3.

The embodiment according to FIG. 6 differs from the embodiment according to FIGS. 3 to 5 substantially only in that the control ducts 35 and associated non-return valves 38 are arranged on the ancillary plate 16 of the cutting head 3 over two concentric circles, the control ducts being connected on the two graduated circles by means of a common connecting duct or, as shown, by means of a respective connecting duct 37 to a group of spray nozzles. The control opening 23 on the end face 25 of the piston 20 is such that it simultaneously intersects control ducts 35 on the two circles. With this design, the control opening 23 has an approximately rectangular or oval peripheral shape.

It is also possible to provide a cutting head with several pistons 20 which cooperate with the control ducts 35 lying on a common graduated circle or on two or more graduated circles. If several pistons 20 are provided, they can be selected, for example, by means of directional control valves. This arrangement allows the spray angle during spraying of the cutting track to be varied as a function of the respective operating conditions.

In a preferred embodiment, the piston 20 is orientated with its piston axis parallel to the axis of rotation of the cutting head 3 as shown in FIGS. 3 to 6. However, as shown in FIGS. 7 and 8, it is possible to arrange the piston 20 radially to the axis of rotation of the cutting head 3. In this case, the control surface 24 is formed by a cylindrical surface concentric with the axis of rotation of the cutting head 3, and the control ducts 35 and the non-return valves 38 are arranged in a radial orientation on the annular ancillary plate 16. It goes without saying that several pistons 20 and/or several graduated circles with control ducts 35 can also be provided with this embodiment.

Figure 9:
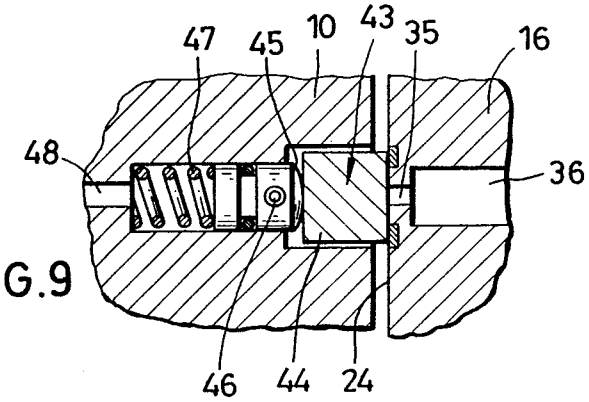
FIG. 9 shows an alternative embodiment of a valve device, in a sectional view corresponding to FIG. 4.
Figure 10:
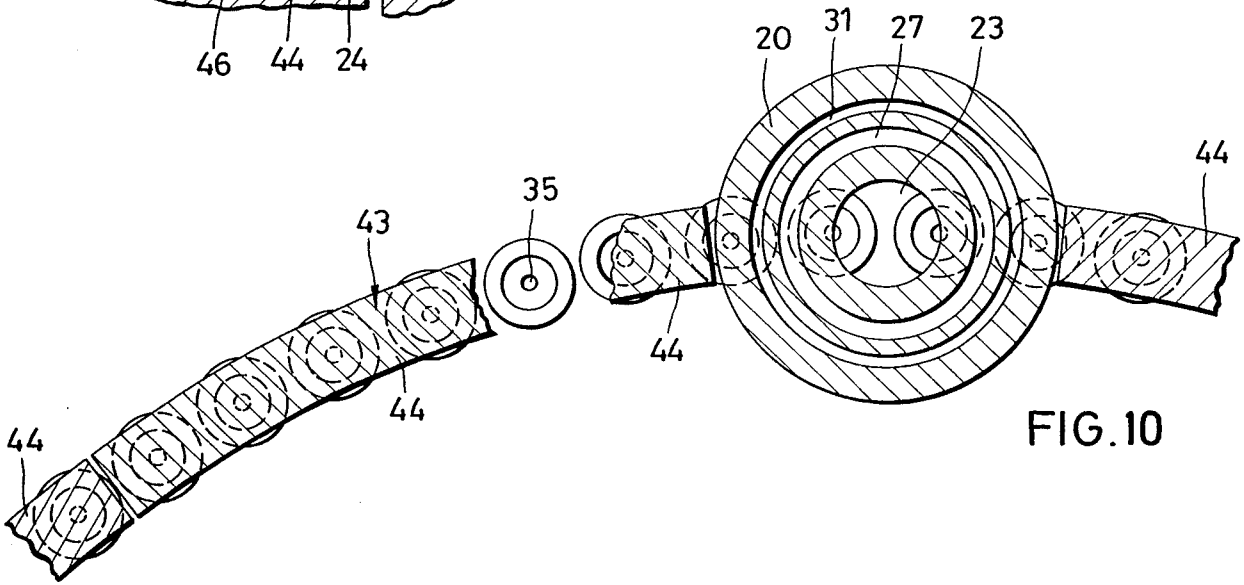
FIG. 10 shows the arrangement of FIG. 9 in an axial partial section.

Instead of non-return valves 38, it is also possible to use valves of a different design for blocking the control ducts 35 against the reflux of water. FIGS. 9 and 10 show a valve which is comparatively simple in structure, and which is arranged on the ancillary plate 10 connected to the boom 1, and so does not participate in the rotational movement of the cutting head 3. The valve has, as a closure member, a ring segment sealing strip 43. The sealing strip 43 is preferably composed of several sealing strip segments 44. The sealing strip 43 (or the sealing strip segments 44) is mounted for axial movement in an annular groove 45 in the ancillary plate 10. Rams 46 are provided for pressing the sealing strip 43 against the control surface 24, the rams being distributed around the sealing strip, and being charged, from the rear, by springs 47 and/or by hydraulic fluid via a hydraulic high pressure water supply line 48. The sealing strip 43 can, therefore, be pressed against the control surface 24 to seal the control ducts 35. The sealing strip 43 extends over the entire periphery of the ancillary plate 10, with the exception of the peripheral region in which the piston 20 is located. In the cutting region, therefore, the supply of high pressure water to the rotating cutting head 3 is effected via the control opening 23 of the piston 20 and the aligned control duct(s) 35, the other (non-aligned) control ducts 35 being blocked by the sealing strip 43. It goes without saying, that this design of valve can also be used in the embodiments according to FIGS. 7 and 8.

With a cross-axis cutting assembly 2 according to FIG. 2, each cutting head 3 is provided with a spraying arrangement of any of the types described above. The spraying arrangement according to the invention can, however, also be used in other cutting head arrangements. Since the parts serving for the supply and distribution of the spray water, as well as the control of the various spray nozzles and nozzle groups, are arranged in the plates 10 and 16, simple assembly and disassembly of these parts is possible.

I claim:

1. A cutting head for a selective cutting machine, the cutting head being rotatably mounted on a boom, the cutting head including a plurality of spray nozzles, a plurality of control ducts for feeding pressurised water to the spray nozzles, and a control surface surrounding and arranged concentrically with respect to the axis of rotation of the cutting head, the control ducts leading from the control surface and being connected to a high pressure water supply line via a piston having a free end surface which is dimensioned and arranged to slidably contact only an angular segment of the control surface, with the remainder of the control surface being free from contact with the free end surface of the piston, the piston being provided with a passage passing therethrough, one end of the piston passage being connected to the high pressure water supply line, and the other end of the piston passage terminating in a control opening formed in said free end surface of the piston.

2. A cutting head according to claim 1, further comprising valve means for preventing the return of pressurized water to control ducts leading from the remainder of the control surface which is free from contact with the free end surface of the piston.

3. A cutting head according to claim 1, wherein the piston is a stepped piston.

4. A cutting head according to claim 1, wherein the control opening has a greater cross-sectional area than the piston passage.

5. A cutting head according to claim 1, wherein the control opening is of such a size that at least one control duct is always intersected by the control opening.

6. A cutting head according to claim 3, wherein said free end surface of the piston includes an annular groove which surrounds the control opening, said annular groove being connected to a leakage duct.

7. A cutting head according to claim 6, wherein the piston includes at least one grease duct for continuously feeding lubrication grease to said free end surface of the piston.

8. A cutting head according to claim 7, wherein said at least one grease duct opens into a second annular groove formed in said second free end surface of the piston, said annular groove surrounding the annular groove connected to the leakage duct as well as the control opening.

9. A cutting head according to claim 1, further comprising a spring for biasing the piston to bring said free end surface into sealing contact with the control surface.

10. A cutting head according to claim 6, wherein the stepped piston is movably guided in a stepped passage having a smaller diameter portion and a larger diameter portion, the smaller diameter portion being connected to the high pressure water supply line and the larger diameter portion being connected to the leakage duct, the piston passage opening into said smaller diameter portion, and the leakage duct opening into said greater diameter portion.

11. A cutting head according to claim 10, wherein said stepped passage is formed in an annular ancillary plate detachably fixed on the side of the boom.

12. A cutting head according to claim 11, wherein the control ducts are formed in a further annular ancillary plate, the control surface being formed on said further annular ancillary plate.

13. A cutting head according to claim 12, wherein a gap is provided between said ancillary plates, said gas being sealed by a sealing ring.

14. A cutting head according to claim 1, wherein the piston includes rotation prevention means.

15. A cutting head according to claim 1, wherein a plurality of adjacent control ducts are joined together by connecting ducts to form a group.

16. A cutting head according to claim 1, wherein the cutting head includes further control ducts, said further control ducts being arranged around the periphery of a circle which is concentric with said first-mentioned circle.

17. A cutting head according to claim 16, wherein the control opening of the piston intersects the control ducts of both circles.

18. A cutting head according to claim 1, wherein the longitudinal axis of the piston is parallel to the axis of rotation of the cutting head.

19. A cutting head according to claim 1, wherein the longitudinal axis of the piston is transverse to the axis of of rotation of the cutting head, the piston being adjustable by water pressure against the control surface which is an annular cylindrical surface surrounding the axis of rotation of the cutting head.

20. A cutting head according to claim 12, wherein the cutting head has a tapered portion at the end connected to the boom, said ancillary plate being detachably fixed within said tapered portion, and said further ancillary plate fitting into said tapered portion, said further ancillary plate being connected to the boom.

21. A cutting head as claimed in claim 20, wherein said further ancillary plate is connected to the boom via an intermediate plate.

22. A cutting head according to claim 2, wherein the valve means includes a respective non-return valve arranged within each of the control ducts.

23. A cutting head according to claim 22, wherein each non-return valve is a spring-loaded ball check valve having a conical support surface for receiving the valve ball when that valve is in the open position.

24. A cutting head according to claim 11, wherein a valve means is arranged on the ancillary plate, said valve means consisting of a sealing strip which is adjustable by spring force and/or by hydraulic loading against the control surface, the sealing strip being effective to close the control ducts with the exception of the control duct(s) aligned with the control opening of the piston.

25. A cutting head according to claim 24, wherein the sealing strip is arranged in a groove, and is loaded at the rear by springs and/or by hydraulically loaded pistons.

26. A cutting head according to claim 24, wherein the sealing strip is of multi-part construction.

* * * * *